US008172436B2

(12) United States Patent
Coleman et al.

(10) Patent No.: US 8,172,436 B2
(45) Date of Patent: May 8, 2012

(54) ROTATING LED LIGHT ON A MAGNETIC BASE

(75) Inventors: Edward S. Coleman, Ridgefield, CT (US); Qiu Jianping, Hangzhou (CN)

(73) Assignee: Ullman Devices Corporation, Ridgefield, CT (US)

( * ) Notice: Subject to any disclaimer, the term of this patent is extended or adjusted under 35 U.S.C. 154(b) by 248 days.

(21) Appl. No.: 12/628,356

(22) Filed: Dec. 1, 2009

(65) Prior Publication Data

US 2011/0128723 A1 Jun. 2, 2011

(51) Int. Cl.
*F21S 8/00* (2006.01)

(52) U.S. Cl. ..... 362/421; 362/249.02; 362/371; 362/398

(58) Field of Classification Search ..... 362/249.01, 362/249.02, 249.03, 249.12, 249.07, 365, 362/370, 371, 398, 269, 427, 421
See application file for complete search history.

(56) References Cited

U.S. PATENT DOCUMENTS

| | | | | |
|---|---|---|---|---|
| 4,581,686 | A | 4/1986 | Nelson | |
| 6,140,934 | A * | 10/2000 | Lam | 340/815.4 |
| 6,457,841 | B1 | 10/2002 | Lynch et al. | |
| 6,485,160 | B1 * | 11/2002 | Sommers et al. | 362/184 |
| 6,530,680 | B2 * | 3/2003 | Sipala | 362/398 |
| 6,641,283 | B1 | 11/2003 | Bohler | |
| 7,367,689 | B2 | 5/2008 | Huang | |
| 7,896,520 | B1 * | 3/2011 | Norling et al. | 362/191 |
| 2002/0191396 | A1 * | 12/2002 | Reiff et al. | 362/246 |
| 2006/0061991 | A1 * | 3/2006 | Yeh | 362/250 |
| 2009/0027900 | A1 * | 1/2009 | Janos et al. | 362/373 |

* cited by examiner

*Primary Examiner* — John A Ward
(74) *Attorney, Agent, or Firm* — Bachman & LaPointe, P.C.

(57) ABSTRACT

A battery powered rotating LED lighting assembly with a magnetic base, a housing and a pivot post attached to the housing. The lighting assembly housing is supported by the pivot post, which is supported by a support assembly in the base.

26 Claims, 11 Drawing Sheets

ROTATING LED LIGHT ON A MAGNETIC BASE

This invention relates to auxiliary lighting, and more particularly, to an auxiliary puck light with a pivoting head.

Auxiliary lighting takes on many functionalities in the modern world. Lighting is needed in spaces that require visibility, such as closets, cabinets, under cabinets, tents, automobiles etc. In the working environment, a worker usually requires light in the region that he/she has to work. Either a separate person is employed to hold and direct the light or the light is hung in place. The hung light may swing or become unstable. If the light is fixed in place to avoid instability, the light is usually difficult to adjust or rotate. Changing the illuminating direction and/or region of the light is difficult. In addition, fixed lights restrict the applicable range of the light and transportation of the lighting source.

The above lights generally utilize fluorescent or incandescent lamps as a light source. Fluorescent and incandescent lamps typically require filaments and cathode tubes for operation. As such, they are fragile and have a relatively short operating life. Furthermore, filament lamps are not the most economical to operate. In addition, by producing light by heating a filament, incandescent lamps generate a great deal of heat. This heat build up limits the effectiveness of traditional auxiliary lighting due to safety considerations and the possibility of unintentionally and adversely heating items in the near vicinity. This heat generation also makes traditional puck lights less versatile in that some places in which such a light would be desired cannot accommodate a large buildup of heat (e.g. closets, shelves, etc.). Moreover, traditional incandescent and fluorescent lights are quite inefficient. Incandescent lights convert a large amount of energy to heat rather than light, and fluorescent lamps have a relatively high start up power consumption.

Light Emitting Diodes (LEDs) are solid-state semi-conductor devices that convert electrical energy into light. LEDs are made from a combination of semi-conductors and generate light when current flows across the junctions of these materials. The color of the light produced by the LED is determined by the combination of materials used in its manufacture. LEDs have made significant advances in providing a higher performing light source since their inception. For example, red-emitting AlGaAs (aluminum gallium arsenide) LEDs have been developed with efficacies greater than 20 lumens per electrical watt, such devices being more energy efficient and longer lasting producers of red light than red-filtered incandescent bulbs. More recently, AlGaInP (aluminum gallium indium phosphide) and InGaN (indium gallium nitride) LED's have succeeded AlGaAs as the brightest available LEDs. As a result, LEDs have become cost effective replacements for standard incandescent light sources in various applications, such as automotive brake lights, roadway work zone safety lights and red stoplights. It would be advantageous to provide an LED light source for auxiliary lighting, which replaces the traditional filament or fluorescent lamp with an LED light source.

SUMMARY OF THE DISCLOSURE

The primary object of the present disclosure is the creation of a rotating LED light on a magnetic base.

A further object of the present disclosure is the creation of an illumination system that includes an LED module or housing and a mounting base. A plurality of LEDs are mounted on the housing to serve as a light source and generates a light pattern. The housing can be easily rotated about the base unit to provide a rotatable mounting architecture. A battery system provides power to the LEDs.

BRIEF DESCRIPTION OF THE DRAWINGS

A detailed description of preferred embodiments of the present invention follows, with reference to the attached drawings, wherein.

DETAILED DESCRIPTION

This disclosure is drawn to a puck shaped LED light with a rotating magnetic base.

Figure 1:
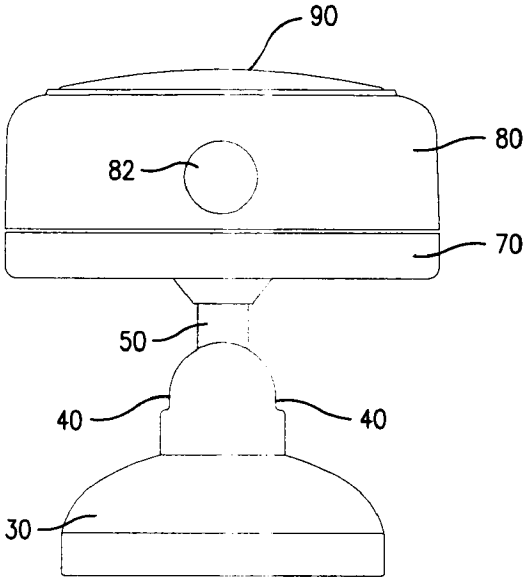
FIG. 1 illustratively depicts the auxiliary light source as claimed.

FIG. 1 details the puck shaped auxiliary light of the present disclosure. 10 depicts a magnetic base of the light attached to base 30 with notches 40 on both sides of the opening designed to fit post 50. The LED puck shaped housing 80 is threadedly attached to housing bottom 70, which is attached by any means well known within the art to post 50. Top 90 is the transparent window of the light.

The auxiliary light of the present invention may be made from any materials that are well known within the art. For instance, the base 30 may be composed of acrylonitrile butadiene styrene (ABS) plastic resin, the magnetic base 10 may be composed of a sturdy rubber or plastic material, the housings 80 and 70 may be composed of color anodized aluminum, ABS, mixtures thereof or the like and the post 50 may be composed of nylon resin, such as PA6+30% GF, steel alloy, such as carbon steel, mixtures thereof or the like.

Figure 2:
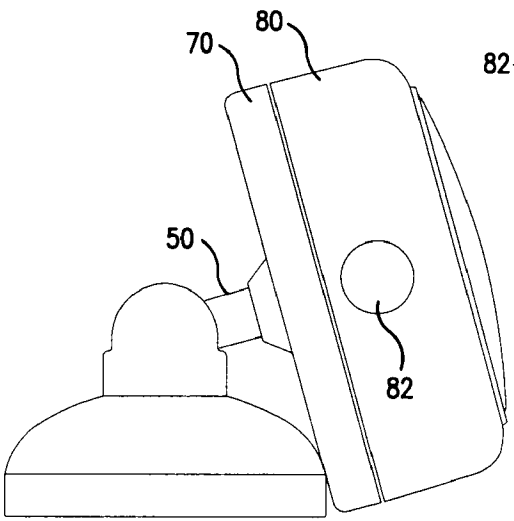
FIG. 2 illustratively depicts the rotational movement of the auxiliary light source as claimed.
Figure 12:
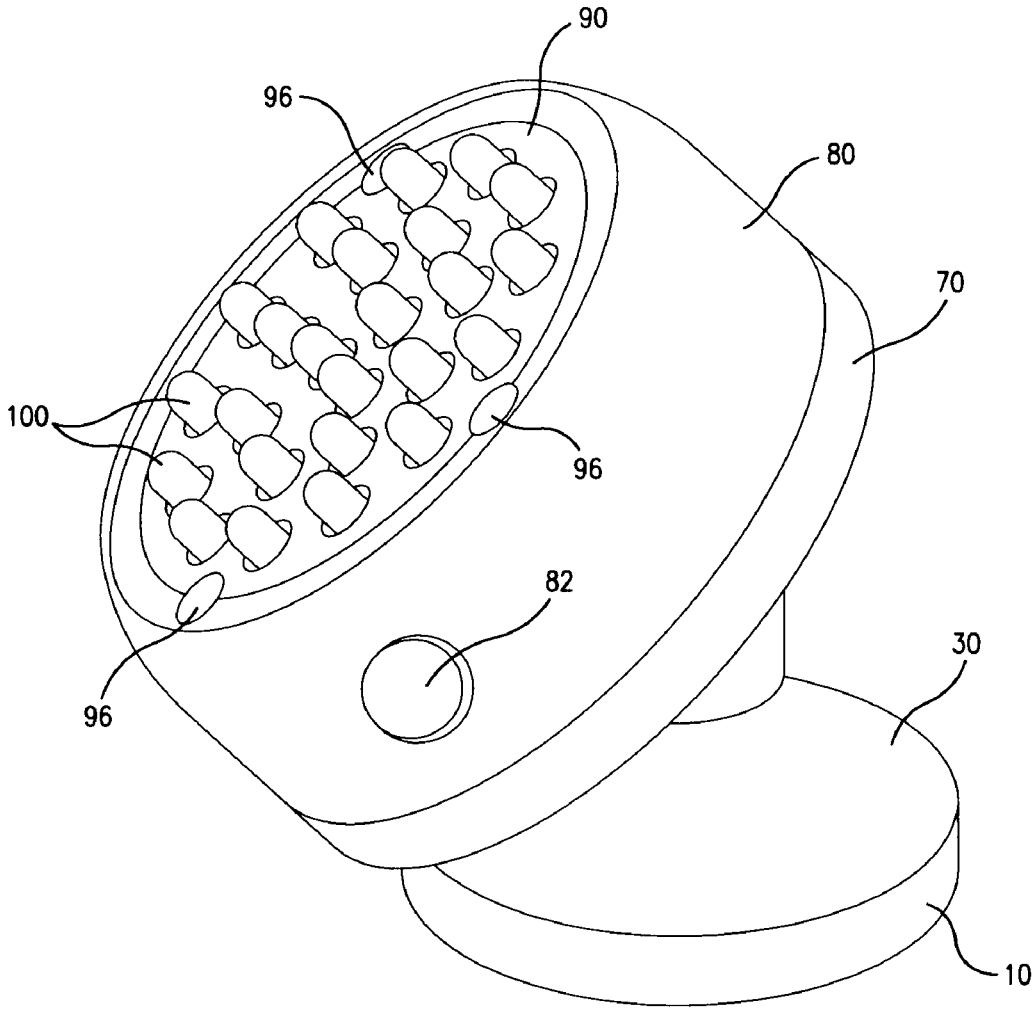
FIG. 12 illustratively depicts the far most pivot position of the auxiliary light source as claimed.

On/Off switch 82 contacts batteries located inside housing 80 in order to activate the electrical connection supplied to LED lights arranged at the top of housing 80. See FIG. 4. FIGS. 2 and 12 depict post 50 in one of the furthest pivoting positions. Notch 40 on each side of post 50 is designed to extend far enough into base 30 so that housing bottom 70 will hit base 30 when the pivot post 50 is in the furthest position.

Figure 5A:
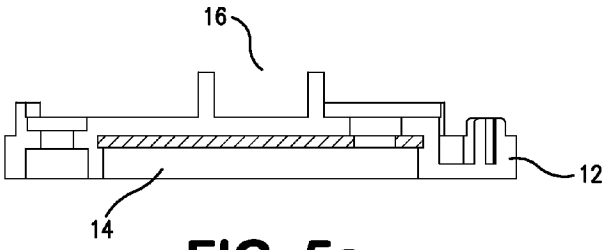
FIG. 5*a* illustratively depicts a transactional view of the magnet housing 12 of the auxiliary light source as claimed.
Figure 5B:
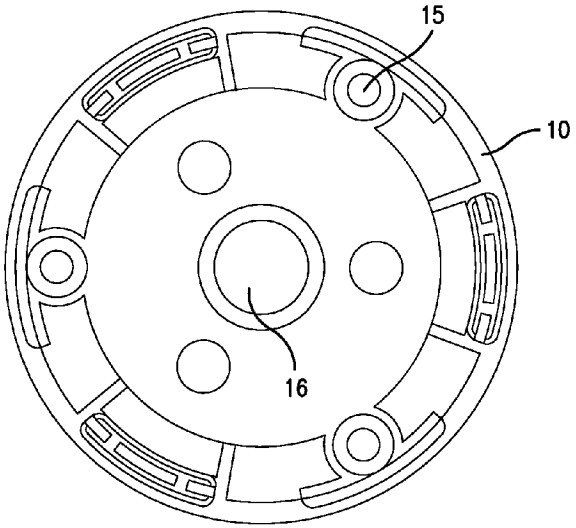
FIG. 5*b* illustratively depicts a top view of magnetic base 10 of the auxiliary light source as claimed.
Figure 4:
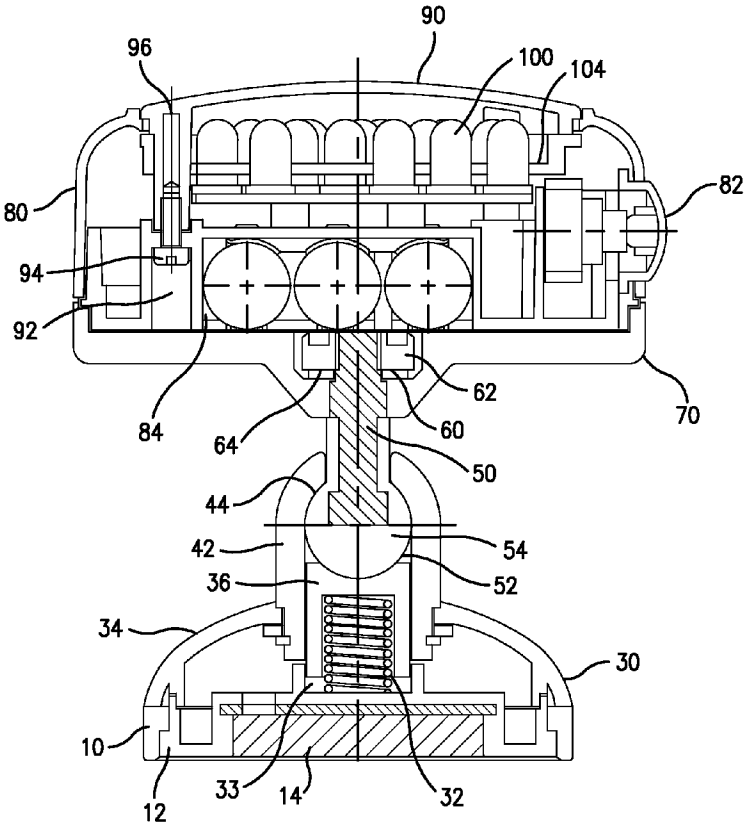
FIG. 4 illustratively depicts a transactional view of the auxiliary light and a non-limiting embodiment of the rotation apparatus and connection of the rotation apparatus on the housing bottom 70 of the auxiliary light source as claimed.
Figure 6A:
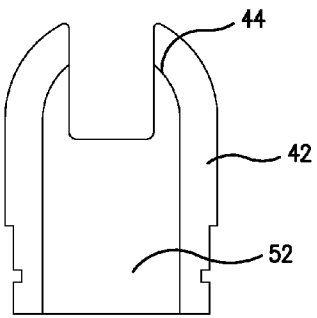
FIG. 6*a* illustratively depicts a transactional view of the spaced support walls 42 of the auxiliary light source as claimed.
Figure 6B:
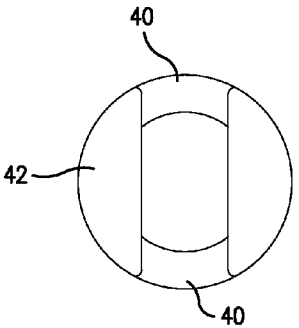
FIG. 6*b* illustratively depicts a top view of the spaced curvature of the support walls 44 and rotation support notches 40 of the auxiliary light source as claimed.

FIG. 4 depicts one embodiment of the present invention. Base 30 is attached to a magnetic base 10, which defines a magnet housing 12 for a magnet 14. The magnet housing 12 also defines a receptacle 16 for holding spring 32. FIG. 5*a* shows a side view of magnet housing 12. FIG. 5*b* shows a top view of magnetic base 10, which surrounds the top of magnet housing 12. As shown in FIGS. 4, 6*a*, 6*b*, 7*a* and 7*b*, the receptacle may be defined for post 50 by two upstanding spaced support walls 42 preferably having curved inner surfaces 44 closely matched to the shape of a balled end 54 of post 50. Upstanding walls 42 define an inner chamber 52 which holds the upper housing (80 and 70) support system. FIG. 6*b* shows a top view of the spaced walls 42 with the curved inner surfaces 44 and notches 40 in relation to curved inner surfaces 44.

FIGS. 4, 6*a*, 7*a*, 8 and 9 depict upstanding walls 42 attached by any means that is well known within the art to base 30 defining an inner chamber 52 which slidably holds a piston 36 which can have an end 38 shaped to match balled end 54 of post 50. A spring 32 biases piston 36 against balled end 54 so as to frictionally hold balled end 54 in a desired location relative to base 30.

Figure 10A:
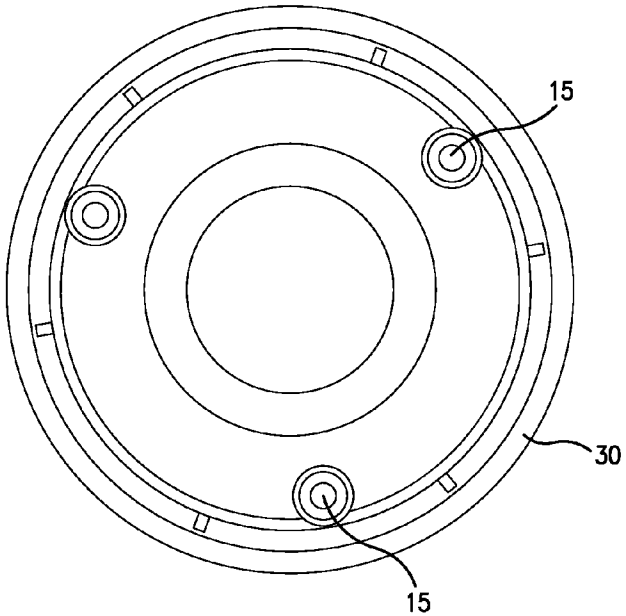
FIG. 10*a* illustratively depicts a bottom view of the inside of base 30 of the auxiliary light source as claimed.
Figure 10B:
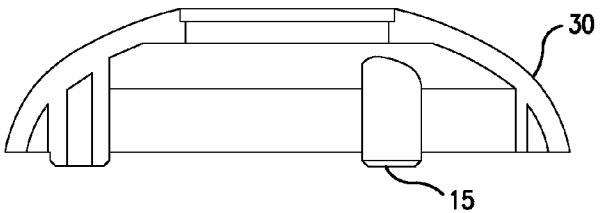
FIG. 10*b* illustratively depicts a transactional view of base 30 of the auxiliary light source as claimed.

Continuing on FIGS. 4, 6*a*, 7*a*, 8 and 9, spring 32 is positioned to exert force on the rounded posterior end 54 of post 50. Spring 32, as part of the support assembly, adds stability and strength to positions of post 50. At its bottom, base 30 is attached to magnet base 10 and magnet housing 12 by screws through screw holes 15. See also FIGS. 5*b* and 10*a*-*c*. FIG. 10*a* shows a bottom view of housing 30, FIG. 10*b* shows a cross sectional side view of housing 30 and FIG. 10*c* shows a cross sectional side view of the screw attachment 15 of magnet base 10 and magnetic housing 12 to base 30.

Figure 3:
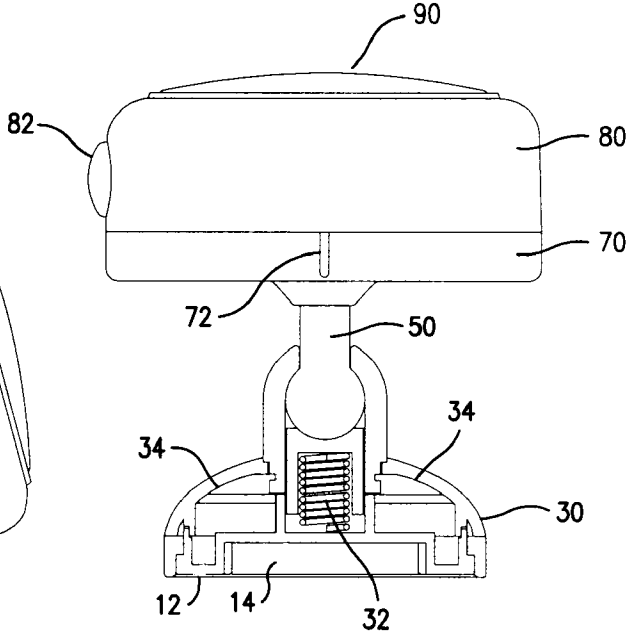
FIG. 3 illustratively depicts a transactional view of the rotation apparatus of the auxiliary light source as claimed.

FIG. 3 also shows marker 72. Marker 72 is used to determine the open/closed position of threadedly attached housing bottom 70 to housing 80. See also FIG. 16.

Figure 8:
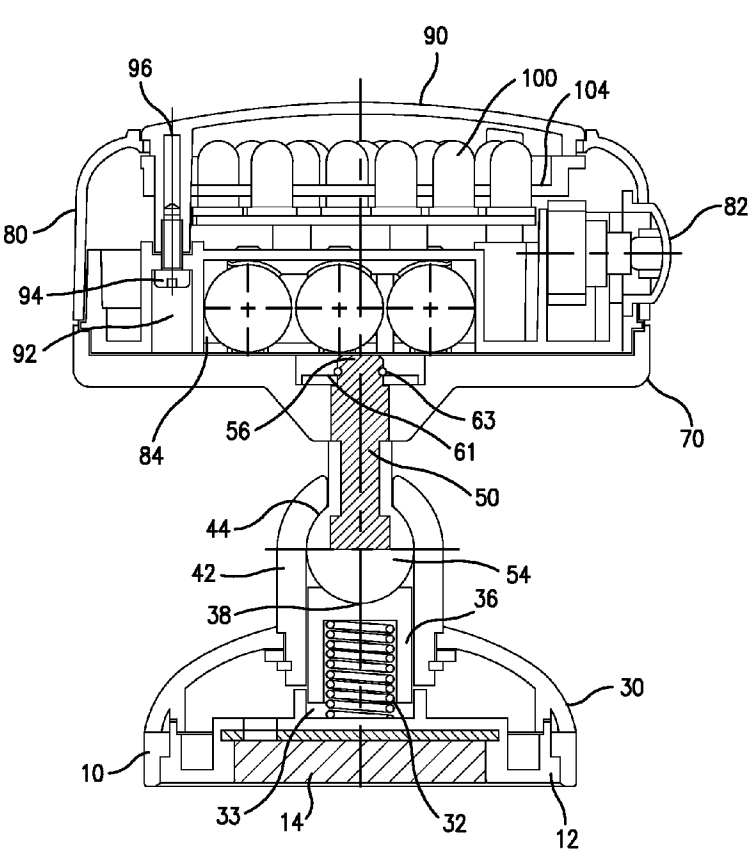
FIG. 8 illustratively depicts a transactional view of the auxiliary light and a non-limiting embodiment of the rotation apparatus and connection of the rotation apparatus on the housing bottom 70 of the auxiliary light source as claimed.
Figure 7A:
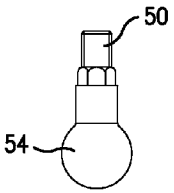
FIG. 7*a* illustratively depicts the rotation apparatus of the auxiliary light source as claimed.
Figure 7B:
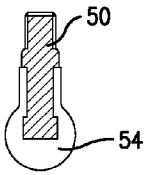
FIG. 7*b* illustratively depicts a transactional view of the rotation apparatus of the auxiliary light source as claimed.
Figure 7C:
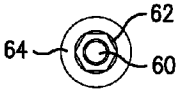
FIG. 7*c* illustratively depicts a top view of the connection of the rotation apparatus to the bottom housing 70 of the auxiliary light source as claimed.
Figure 9:
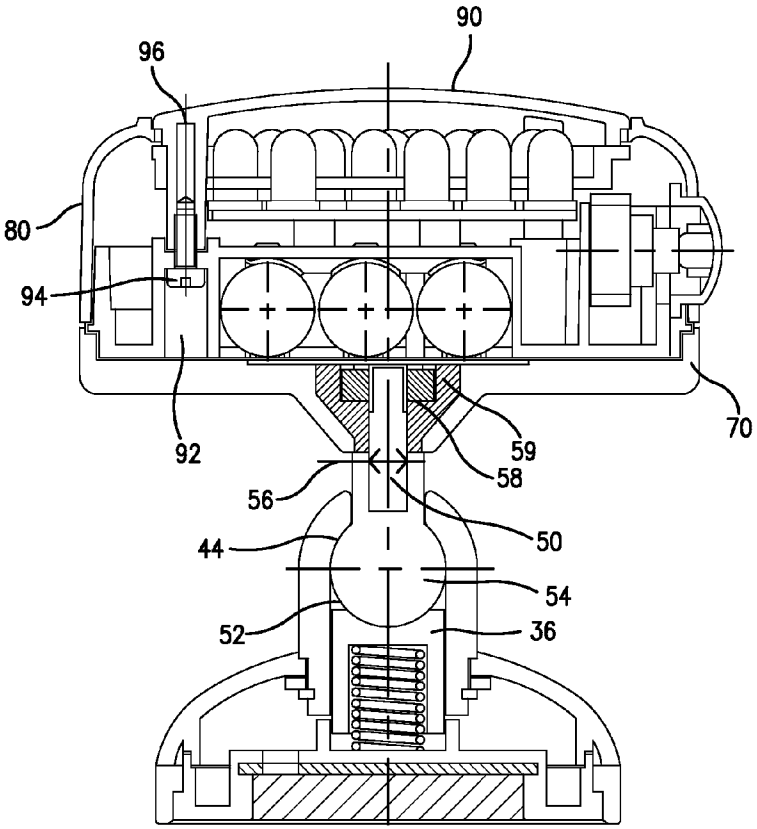
FIG. 9 illustratively depicts a transactional view the auxiliary light and a non-limiting embodiment of the rotation apparatus and connection of the rotation apparatus on the housing bottom 70 of the auxiliary light source as claimed.
Figure 10C:
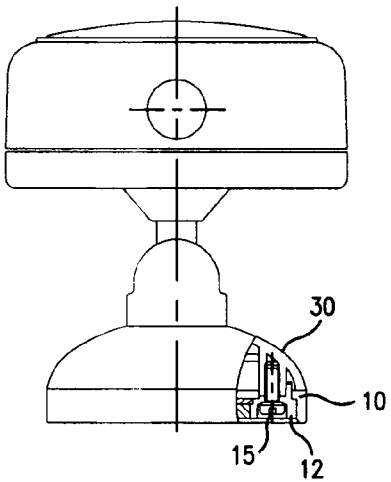
FIG. 10*c* illustratively depicts a transactional view of the connection of the magnet housing 12 and magnetic base 10 to base 30 of the auxiliary light source as claimed.

FIGS. 4, 8 and 9 depict a cross section of the auxiliary light. In the FIG. 4 embodiment, the balled end 54 is made from injection molding. Post 50 is composed of any metal or resin that is well known within the art, such as a steel alloy, i.e. carbon steel. Ball 54 is made from plastic and/or any suitable material that is well known within the art, such as nylon resin. The post 50 and ball 54 assembly are illustrated in the non limiting embodiment of FIG. 4 and FIG. 7*c* as connected to the housing bottom 70 by a threaded screw 60, nut 62, and anti-slip washer 64 connection assembly.

FIG. 8 depicts a cross section of the auxiliary light. In this non limiting embodiment, the balled end 54 is also made from injection molding. The post 50 is molded to have an end 56 shaped to fit a snap ring 63. In this embodiment, the post 50 and ball 54 assembly are connected to the housing bottom 70 by snap ring 63 and flexible washer 61 connection assembly.

FIG. 9 depicts a cross section of the auxiliary light. In this non limiting embodiment, the balled end 54 is also made from injection molding. The post 50 is shaped with an outward flange 59 and embedded in the ball 54 then threadedly attached 58 to ball 54. This embodiment increases the strength of the post 50 and ball 54 assembly by reinforcing the small diameter 56 of post 50. In this embodiment, the post 50 and ball 54 assembly are connected with screws 58 to the housing bottom 70.

Figure 11A:
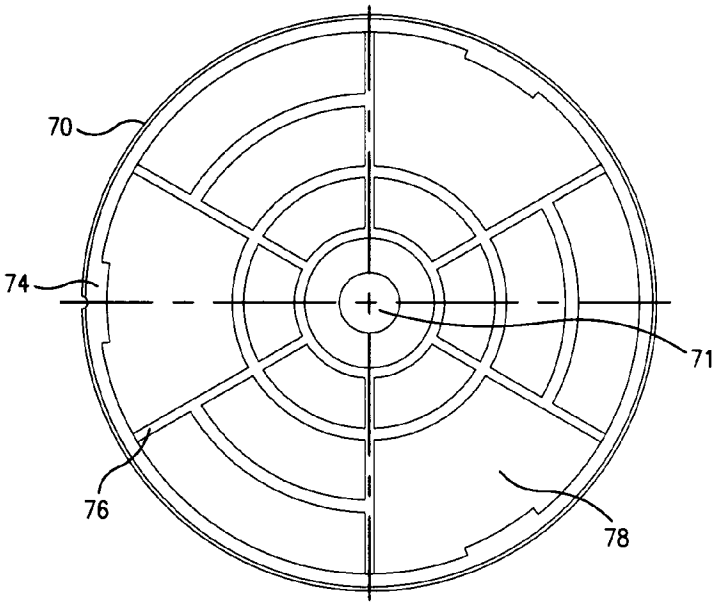
FIG. 11*a* illustratively depicts a top view of the housing bottom 70 of the auxiliary light source as claimed.
Figure 11C:
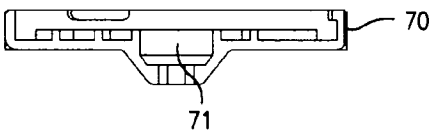
FIG. 11*c* illustratively depicts a transactional view of the housing bottom 70 of the auxiliary light source as claimed.
Figure 11B:
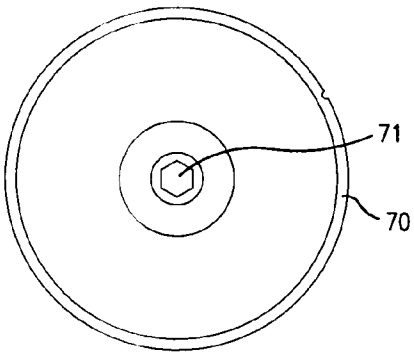
FIG. 11*b* illustratively depicts a bottom view of the housing bottom 70 of the auxiliary light source as claimed.

FIGS. 11*a*-*c* depict the housing bottom 70 of the auxiliary light. FIG. 11*a* depicts the top of housing bottom 70. The housing bottom 70 is designed to threadedly connect to housing 80 by latch tabs 74. For increased strength and stability, vertical reinforcement lines 76 are added to the top of housing bottom 70. In order to create the latch tabs 74, the top of the housing bottom also has empty spaces 78 associated with the latch tab 74 spacing. FIG. 11*b* depicts the bottom of housing 70. FIG. 11*c* depicts a side view of housing 70. Housing bottom 70 is attached to post 50 by screw, latch or any connection method or assembly that is well known within the art in the location of 71.

FIG. 12 depicts the auxiliary light at its furthest pivot position. Housing 80 threadedly attached to bottom 70 is pivoted until bottom 70 rests upon base 30. Housing top 80 contains LEDs 100 protected by top 90. Top 90 includes receptacles 96 designed to correspond to housing holes 92. Please see FIGS. 4, 8, 9, 13 and 19. As described below, receptacles 96 and holes 92 serve in the connection of top 90 to housing 80.

Figure 14:
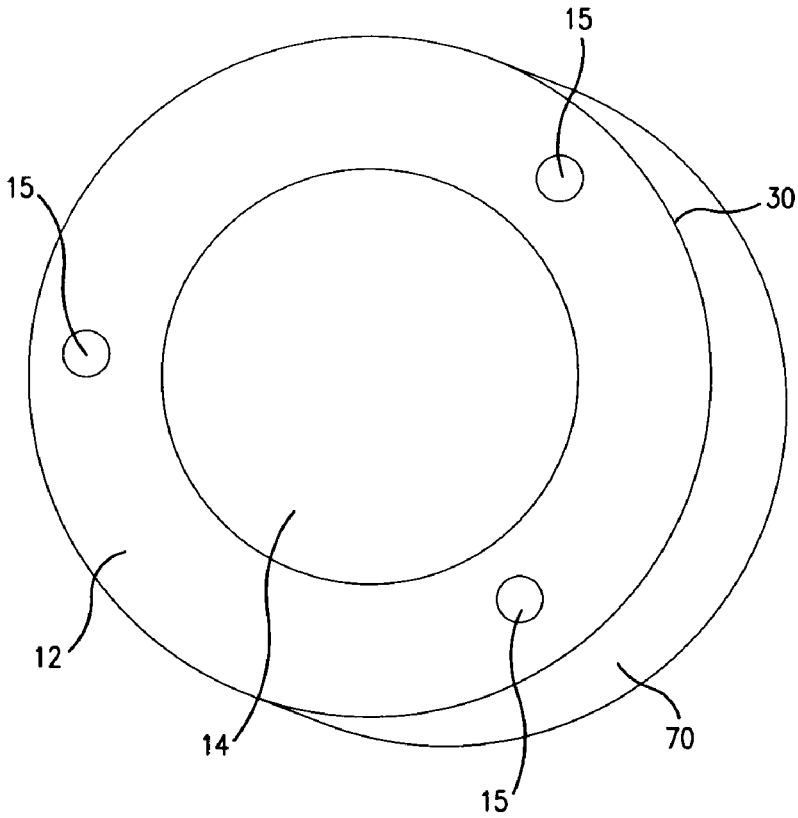
FIG. 14 illustratively depicts a bottom view of the magnetic housing 12 including the magnet 14 of the auxiliary light source as claimed.
Figure 15:
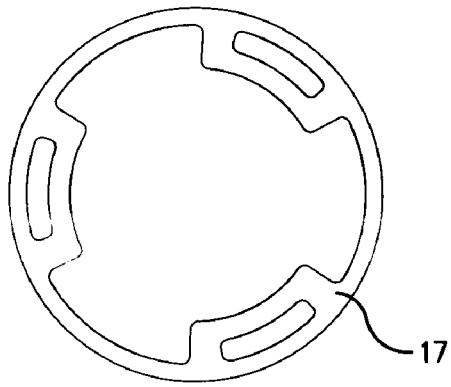
FIG. 15 illustratively depicts the magnet support 17 of the auxiliary light source as claimed.

FIGS. 5*b*, 10*c*, 14 and 15 detail the attachment of the magnet 14 to magnet housing 12. FIG. 14 shows a bottom view of the auxiliary light fully assembled. A rubber support ring 17 (FIG. 15) is placed inside the hollow within magnet housing 12 then magnet 14 is attached to the inside of magnet housing 12 by any method that is well known within the art, such as by glue, screw, tape, mixtures thereof and the like. Once magnet 14 is firmly attached to magnet housing 12, as shown in FIG. 10*c*, magnet housing 12 is covered by magnetic base 10 and housing 12 and magnetic base 10 are screw connected through openings 15 to base 30. The strength of magnet 14 is determined by the size, shape and nature of the auxiliary light. In preferred embodiments, the magnet is strong enough to securely and fixedly hold the auxiliary light on any magnetic surface regardless of the orientation of the light as compared to gravitational forces. Preferably, the magnet strength is 5 to 10 lbs.

Figure 16:
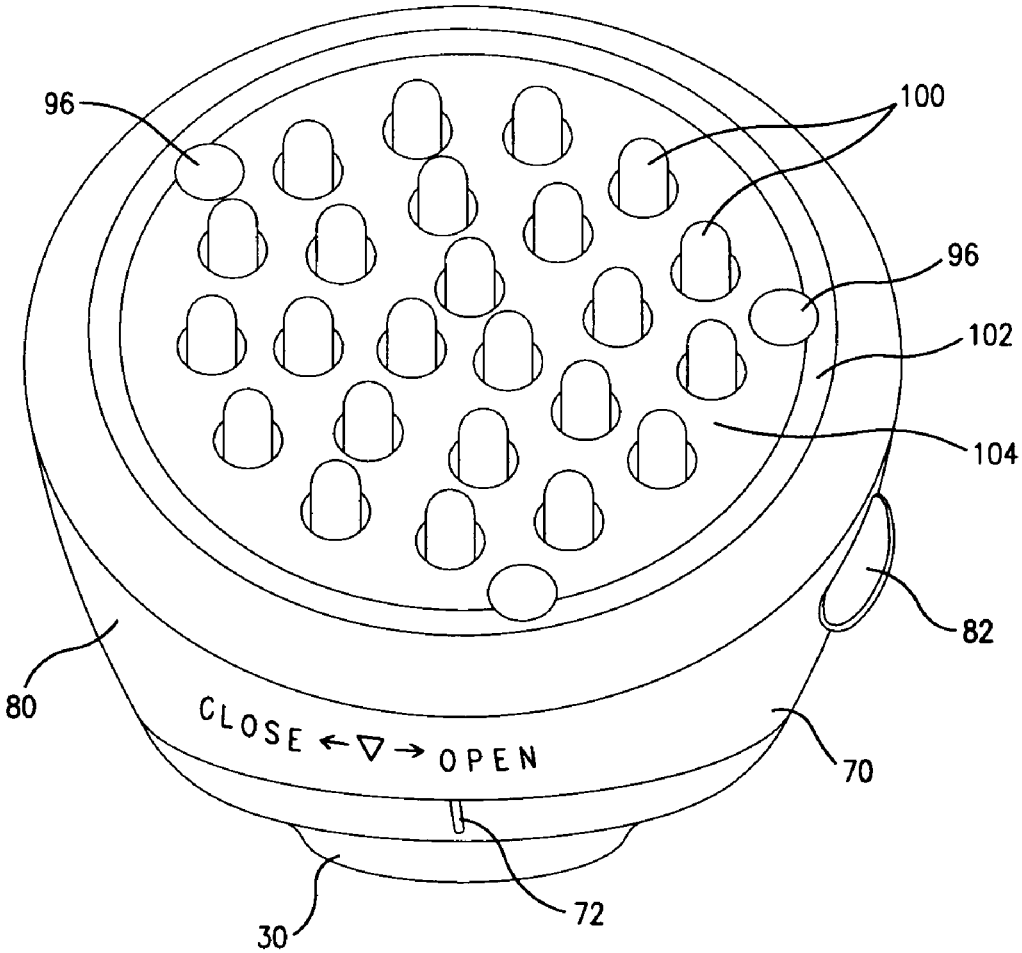
FIG. 16 illustratively depicts a top view of the auxiliary light source as claimed; and, FIG. 17*a* illustratively depicts a top view of the reflective plate 104 of the auxiliary light source as claimed.
Figure 17B:
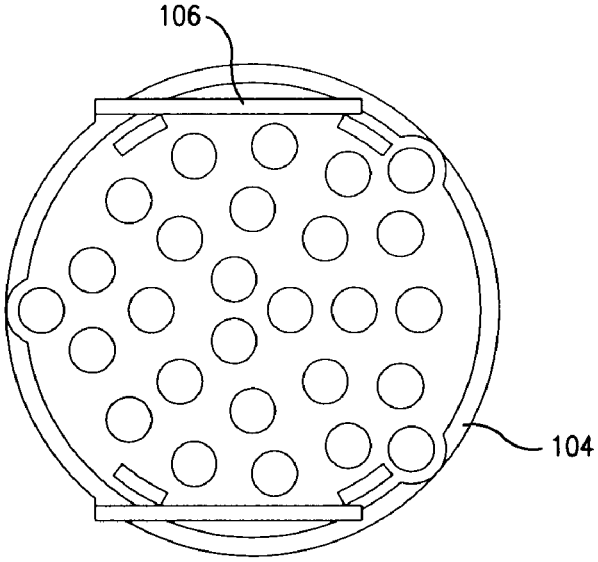
FIG. 17*b* illustratively depicts a bottom view of the reflective plate 104 of the auxiliary light source as claimed.
Figure 17C:
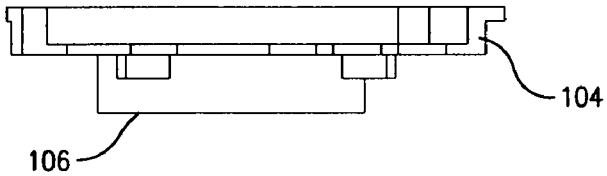
FIG. 17*c* illustratively depicts a transactional view of the reflective plate 104 of the auxiliary light source as claimed.
Figure 17A:
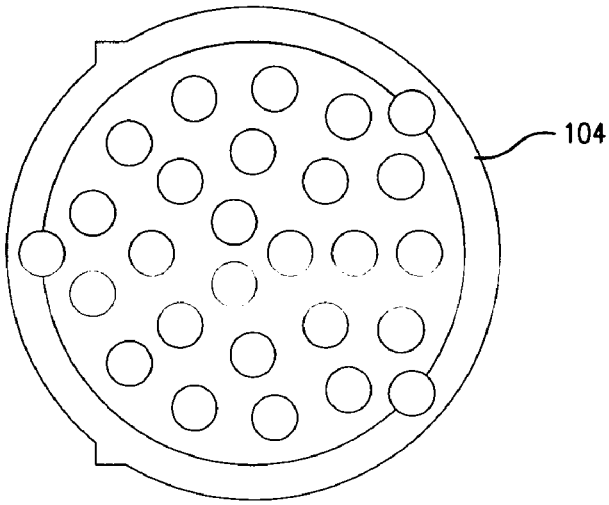
Figure 18A:
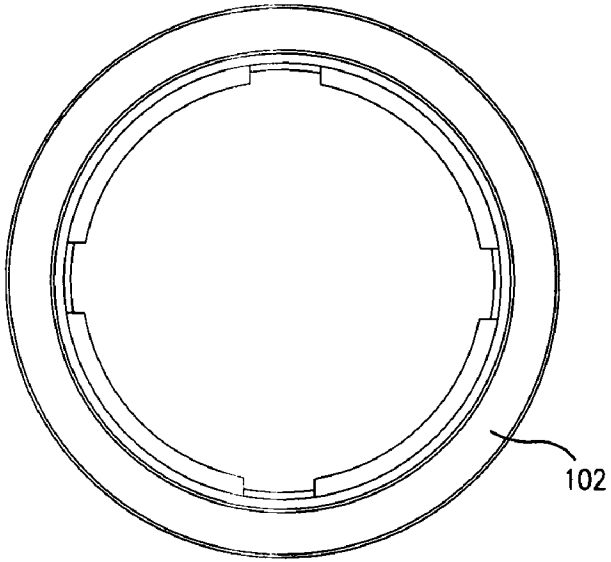
FIG. 18*a* illustratively depicts a top view of the metallic cover 102 of the auxiliary light source as claimed.
Figure 18B:
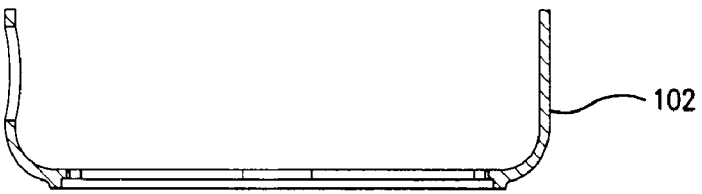
FIG. 18*b* illustratively depicts a transactional view of the metallic cover of the auxiliary light source as claimed; and, FIG. 19 illustratively depicts a top view of the battery compartment 84 of the auxiliary light source as claimed.

FIGS. 4, 8, 9, 12, 16, 17*a-c*, 18*a-b* and 19 depict the top housing 80 of the present invention. In FIG. 16, LEDs 100 are surrounded by metallic cover 102 and arranged on a reflective plate 104. The reflective plate 104 rests atop the metallic cover on supports 106. FIGS. 18*a-b* depict a top view 18*a* and cross sectional side view 18*b* of metallic cover 102. The metallic cover 102 may be made from any metal that is well known within the art, such as aluminum. FIGS. 17*a-c* depict a top 17*a*, bottom 17*b* and side view 17*c* of reflective plate 104. The reflective plate 104 may be any material that has the ability to reflect light, such as a mirror, a sheet of foil, mixtures thereof or the like.

Figure 13B:
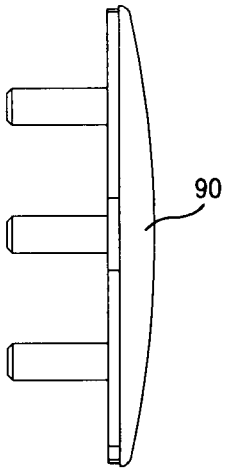
FIG. 13*b* illustratively depicts a side view of the transparent protective top 90 of the auxiliary light source as claimed.
Figure 13A:
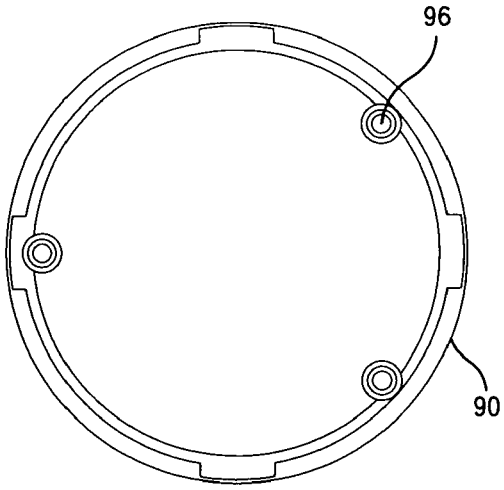
FIG. 13*a* illustratively depicts a bottom view of the transparent protective top 90 of the auxiliary light source as claimed.
Figure 13C:
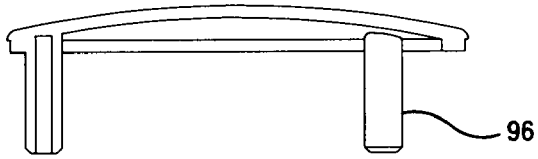
FIG. 13*c* illustratively depicts a transactional view of the transparent protective top 90 of the auxiliary light source as claimed.

Top 90 includes tubular screw attachments 96. FIGS. 13*a-c* show a side view 13*b*, a bottom view 13*a* and a cross sectional side view 13*c* of top 90 with tubular screw attachments 96. These tubular screw attachments 96 are designed to correspond to housing holes 92. As seen in FIGS. 4, 8, 9, 13 and 19, holes 92 travel through housing 80 to battery compartment 84. Screws 94 through holes 92 into attachments 96 are used to secure top 90 to housing 80. Top 90 may be made from any transparent material that is well known within the art, such as transparent polycarbonate resin (PC), transparent PC/ABS resins, mixtures thereof and the like.

Figure 19:
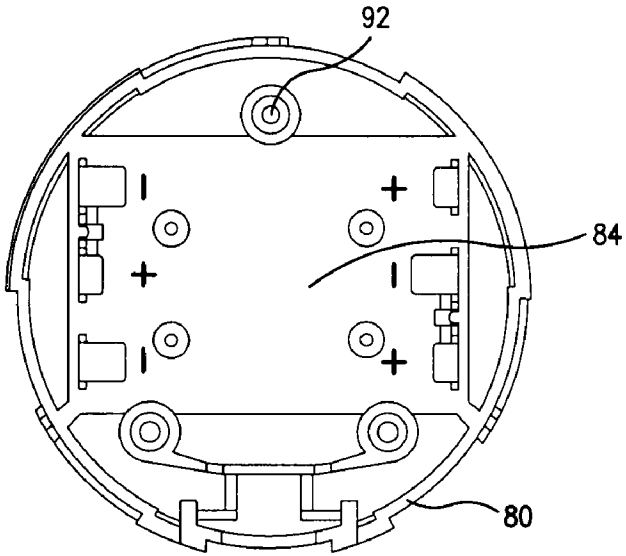

FIG. 19 shows the battery compartment 84 of the present invention. Housing 80 contains the electrical connections for the proper operation of the on/off switch 82 and the LEDs 100. The electrical connection within housing 80 utilized to operate and power the LEDs may be any configuration that is well known within the art.

In addition, the auxiliary light of the present invention may also contain an AC power adapter/recharger for providing AC power to the LEDs and for recharging the DC power source. In addition, the power may be regulated with a switch that can control the level of intensity output of the LEDs.

It is to be appreciated that the various components of the present invention may be connected by any means that is well known within the mechanical arts. The multiple components of the present invention may be threadedly attached, screw attached, glue attached, lock joint with snap ring attached, snapped together, mixtures thereof and the like.

The assembly of the present disclosure may be implemented in other possible applications. The final characteristics of the lighting assembly may be applied to any application that may benefit from the novel properties of the present disclosure. For example, the lighting housing maybe any shape, design or size that may be reasonably associated with the novel rotational mounting. In addition, the LEDs may be incorporated to exhibit any color arrangement as desired for any particular purpose.

It is to be understood that the present disclosure is not limited to the illustrations described and shown herein, which are deemed to be merely illustrative of the best modes of carrying out the invention, and which are susceptible of modification of form, size, arrangement of parts and details of operation. The present disclosure rather is intended to encompass all such modifications which are within its spirit and scope as illustrated by the figures and defined by the claims.

What is claimed is:

1. A lighting assembly, comprising:

a magnetic base;

a housing comprising a plurality of LEDs and a DC power source connected to the LEDs; and a pivot assembly connected between the magnetic base and the housing to allow pivot of the housing relative to the magnetic base, the pivot assembly comprising a pivot post having a ball defined at one end, and spaced support walls defining an inner chamber housing the ball, and further comprising a compression member positioned to exert a holding force on the ball at a location substantially opposite to the pivot post.

2. The lighting assembly according to claim 1, wherein said DC power source is a rechargable battery.

3. The lighting assembly according to claim 1, further comprising an AC power adapter/recharger for providing AC power to said plurality of LEDs and for recharging said DC power source.

4. The lighting assembly according to claim 1, further comprising a switch for controlling a level of light output by the LEDs.

5. The lighting assembly according to claim 1, wherein the LEDs are high intensity white light LEDs.

6. The lighting assembly according to claim 1, wherein the spaced support walls define a pivot post receptacle and an inner chamber and further comprising a spring, a piston and at least one stabilizer in the inner chamber.

7. The lighting assembly according to claim 6, wherein the piston has an end shaped to correspond to an end shape of the pivot post.

8. The lighting assembly according to claim 7, wherein the spring holds the pivot post in a position relative to the base by biasing the piston against the end of the pivot post.

9. The lighting assembly according to claim 1, wherein the spaced support walls have curved inner surfaces closely matched to the shape of the ball on the pivot post.

10. The lighting assembly according to claim 1, wherein the housing is puck shaped.

11. The lighting assembly according to claim 1, wherein the magnetic base comprises a magnet housing comprising at least one magnet.

12. The lighting assembly according to claim 11, wherein the strength of the magnet is 5 to 101 bs.

13. The lighting assembly according to claim 1, wherein the pivot post is comprised of a metal post with molded plastic defining the ball.

14. The lighting assembly according to claim 13, wherein the pivot post is attached to the housing by a connection assembly comprising at least one threaded screw, wherein the metal post is shaped with an outward flange that is screw connected to the molded plastic.

15. The lighting assembly according to claim 1, wherein the pivot post is attached to the housing by a connection assembly comprising at least one threaded screw, at least one nut and at least one anti-slip washer.

16. The lighting assembly according to claim 1, wherein the pivot post is attached to the housing by a connection assembly comprising at least one snap ring and at least one flexible washer.

17. The lighting assembly according to claim 1, wherein the base is composed of acrylonitrile butadiene styrene (ABS) plastic resin.

18. The lighting assembly according to claim 1, wherein the magnetic base is composed of a rubber.

19. The lighting assembly according to claim 1, wherein the housing is composed of a material selected from the group consisting of color anodized aluminum, ABS, and mixtures thereof.

20. The lighting assembly according to claim 1, wherein the pivot post is composed of a material selected from the group consisting of nylon resin, steel alloy or combinations thereof.

21. The lighting assembly according to claim 1, further comprising a transparent housing top covering the LEDs.

22. The lighting assembly of claim 1, wherein the spaced support walls further define an inner area housing the compression member in frictional contact with the ball.

23. The lighting assembly of claim 1, wherein the compression member comprises a piston biased against the ball.

24. The lighting assembly of claim 23, wherein the compression member is biased against the ball by a spring.

25. The lighting assembly of claim 24, wherein the piston has a stabilizer.

26. A lighting assembly, comprising:

a base comprising a magnet base and spaced support walls;

a housing comprising a plurality of LEDs and a DC power source connected to the LEDs; and a pivot post attached to the housing, wherein the spaced support walls and the pivot post are pivotably connected by a ball defined on the pivot post and an inner chamber defined by the spaced support walls, wherein the inner chamber houses the ball, wherein the spaced support walls define a pivot post receptacle and an inner chamber and further comprising a spring, a piston and at least one stabilizer in the inner chamber.

* * * * *